US011193493B2

(12) United States Patent
Lee

(10) Patent No.: US 11,193,493 B2
(45) Date of Patent: Dec. 7, 2021

(54) WATER PUMP

(71) Applicant: AMOTECH CO., LTD., Incheon (KR)

(72) Inventor: Jeong Hoon Lee, Seoul (KR)

(73) Assignee: AMOTECH CO., LTD., Incheon (KR)

( * ) Notice: Subject to any disclaimer, the term of this patent is extended or adjusted under 35 U.S.C. 154(b) by 203 days.

(21) Appl. No.: 16/314,765

(22) PCT Filed: Jun. 29, 2017

(86) PCT No.: PCT/KR2017/006898
§ 371 (c)(1),
(2) Date: Jan. 2, 2019

(87) PCT Pub. No.: WO2018/008896
PCT Pub. Date: Jan. 11, 2018

(65) Prior Publication Data

US 2019/0309754 A1 Oct. 10, 2019

(30) Foreign Application Priority Data

Jul. 4, 2016 (KR) ..... 10-2016-0084181
Jul. 4, 2016 (KR) ..... 10-2016-0084184
Aug. 31, 2016 (KR) ..... 10-2016-0111629

(51) Int. Cl.
*F04D 13/08* (2006.01)
*F04D 29/046* (2006.01)
(Continued)

(52) U.S. Cl.
CPC ..... *F04D 13/086* (2013.01); *F04D 29/046* (2013.01); *F04D 29/20* (2013.01);
(Continued)

(58) Field of Classification Search
CPC ..... F04D 13/086; F04D 29/20; F04D 29/242; F04D 29/046; F04D 29/588;
(Continued)

(56) References Cited

U.S. PATENT DOCUMENTS 5,324,171 A * 6/1994 Cook ..... F04B 49/025 200/84 C
2003/0230950 A1* 12/2003 Reimann ..... H02K 5/128 310/192
(Continued)

FOREIGN PATENT DOCUMENTS

JP 2003508689 3/2003
JP 2005098163 4/2005
(Continued)

OTHER PUBLICATIONS

KR20110055297 translation (Year: 2020).*
(Continued)

*Primary Examiner* — Devon C Kramer
*Assistant Examiner* — David N Brandt
(74) *Attorney, Agent, or Firm* — Cantor Colburn LLP

(57) ABSTRACT

Provided is a water pump including: a housing; a support shaft fixed to the housing; an impeller disposed on an upper portion of the housing; a stator disposed inside the housing; a rotor rotatably supported to the support shaft; and a connecting member inserted in the supporting shaft to rotatably support the rotor and connecting between the rotor and the impeller, thereby reducing the number of parts and simplifying a manufacturing process.

15 Claims, 12 Drawing Sheets

(51) Int. Cl.

| | |
|---|---|
| ***F04D 29/58*** | (2006.01) |
| ***F04D 29/20*** | (2006.01) |
| ***F04D 29/24*** | (2006.01) |
| ***F04D 13/06*** | (2006.01) |

(52) U.S. Cl.
CPC ..... *F04D 29/242* (2013.01); *F04D 29/588* (2013.01); *F04D 13/0606* (2013.01)

(58) Field of Classification Search
CPC ..... F04D 13/0606; F04D 29/5806; F04D 13/0626; F04D 13/0633
See application file for complete search history.

(56) References Cited

U.S. PATENT DOCUMENTS

2010/0141058 A1* 6/2010 Kim ..... H02K 11/25 310/43
2011/0116948 A1* 5/2011 Yl ..... H02K 1/148 417/410.1
2013/0183155 A1* 7/2013 Stoicescu ..... F04D 29/2277 416/175
2015/0052935 A1* 2/2015 Aso ..... H02K 11/215 62/467
2015/0292516 A1 10/2015 Ree
2015/0345502 A1* 12/2015 Sinico ..... F04D 13/0606 415/200
2017/0009778 A1* 1/2017 Ye ..... F04D 29/426
2017/0037855 A1* 2/2017 Yin ..... F01P 5/12
2017/0067469 A1* 3/2017 Malvasi ..... F04D 29/0473
2018/0163747 A1* 6/2018 Hayamitsu ..... H02K 9/14
2018/0291919 A1* 10/2018 Stoicescu ..... F04D 29/22

FOREIGN PATENT DOCUMENTS

| | | | | |
|---|---|---|---|---|
| JP | 2012067659 | | 4/2012 | |
| KR | 20110055297 | * | 5/2011 | ..... F01P 5/10 |
| KR | 101296393 | | 8/2013 | |
| KR | 101410628 | | 6/2014 | |
| KR | 101461865 | | 11/2014 | |

OTHER PUBLICATIONS

Edgefx.in (What Are The Advantages Of Using A Printed Circuit Board from edgefx.in/advantages-using-printed-circuit-board-pcb/ ). (Year: 2020).*
Phbcorp.com (What is Aluminum Die Casting_ The Process of Die Casting—PHB Inc_ from phbcorp.com/what-is-aluminum-die-casting/). (Year: 2019).*
The Use of Thermoplastics in Fluid Handling _ Modern Pumping Today from modernpumpingtoday.com/the-use-of-thermoplastics-in-fluid-handling/ (Year: 2020).*
Aluminum Enclosures vs. Plastic Enclosures- Determining the Right Material—TechTalk Blog_Polycase from polycase.com/techtalk/plastic-electronic-enclosures/aluminum-enclosures-vs-plastic-enclosures-determining-the-right-material.html (Year: 2020).*
International Search Report—PCT/KR2017/006898 dated Oct. 25, 2017.

* cited by examiner

WATER PUMP

TECHNICAL FIELD

The present disclosure relates to a water pump, and more particularly, to a water pump capable of reducing the number of parts and simplifying a manufacturing process by improving a coupling structure between an impeller and a rotor.

BACKGROUND ART

In general, a water pump is installed in a drain water tank of a washing machine, or is used for circulation of a coolant that cools an engine for a vehicle.

The water pump includes: a drive unit for generating a driving force under a power-on situation; and a pump unit that is connected to the drive unit which pumps water. Since the water pump performs functions of pumping the water, the water flowing into the drive unit results in a failure of the drive unit. Accordingly, a pump with a mechanical seal structure or a canned pump having a canned cover structure of sealing a stator is used for the purpose of protecting the drive unit from the water.

As disclosed in Korean Patent Registration No. 10-1461865 (registered on Nov. 8, 2014), a conventional water pump includes: a drive shaft connected to and rotated by an impeller; a rotor unit mounted on the drive shaft; a stator unit fixed to a motor housing and corresponding to the rotor unit; a semicircular type bearing mounted on one side of an outer peripheral surface of the drive shaft; and a semicircular type second bearing mounted on the other side of the outer peripheral surface of the drive shaft and fastened to the first bearing.

Since such a conventional water pump requires the drive shaft to be rotatably installed in the housing, a drive shaft support structure becomes complicated, and since the drive shaft and the impeller should be sealably connected to each other, and thus a bearing structure becomes complicated, there is a problem that the number of parts is increased and the manufacturing process is complicated.

DISCLOSURE

Technical Problem

It is an object of the present disclosure to provide a water pump capable of reducing the number of parts and simplifying the manufacturing process by improving a connection structure between an impeller and a rotor.

It is another object of the present disclosure to provide a water pump capable of fundamentally preventing water from being introduced into a stator by partitioning the stator and the rotor with a housing.

It is a further object of the present disclosure to provide a water pump that can reduce the number of parts since the center of the rotor is disposed below the center of the stator and thus a separate component for supporting the lower portion of the rotor is unnecessary due to a rising force caused when the rotor is rotated.

It is a further object of the present disclosure to provide a water pump in which the housing and the lower casing are made of metal with excellent thermal conductivity to smoothly discharge heat generated in the water pump, to thereby prevent at least one of the housing and the lower casing from being damaged by the heating of the water pump.

Technical Solution

According to the present disclosure, there is provided a water pump including: a housing; a support shaft fixed to the housing; an impeller disposed on an upper portion of the housing; a stator disposed inside the housing; a rotor rotatably supported to the support shaft; and a connecting member inserted around the supporting shaft to rotatably support the rotor and connecting between the rotor and the impeller.

The housing includes: an outer wall portion forming an external appearance; an upper plate portion extending inward from an upper end of the outer wall portion; an inner wall portion extending downward from an end portion of the upper plate portion; and a lower plate portion covering a lower portion of the inner wall portion, the stator may be disposed between the outer wall portion and the inner wall portion, and the rotor may be disposed inside the inner wall portion.

The rotor may include: a rotor support connected to the impeller; and a magnet and a back yoke embedded in the rotor support and formed in a cylindrical shape.

The connecting member may include: a rotor fixing portion which is rotatably inserted around the support shaft and is fitted into the rotor; and an impeller fixing portion extending outwardly from an upper surface of the rotor fixing portion and engaging with an engaging portion formed on a lower surface of the impeller.

The connecting member is a sleeve bearing which is fitted to the rotor and is rotatably inserted around the support shaft, and an impeller fixing portion to which the impeller is fixed is formed on an upper surface of the sleeve bearing.

The center of the magnet is positioned lower than the center of the stator by an interval (H), so that an upward force can be applied to the magnet.

The housing may be provided with fixed ribs for aligning the position of the stator and fixing the stator to the housing.

The fixed ribs may protrude from an outer surface of an inner wall of the housing at predetermined intervals, and stator cores may be inserted between the fixed ribs.

A printed circuit board (PCB) for controlling the stator is mounted on a lower side of the housing, a Hall sensor for detecting the number of rotations of the rotor is mounted on one side of the PCB, and connector pins are connected to the other side of the PCB.

The impeller may include: an upper plate having a suction port for sucking water in a center thereof; a lower plate coupled to the upper plate to form a discharge port between the upper plate and the lower plate; and a plurality of blades disposed between the upper plate and the lower plate, for generating a pumping force for discharging water sucked through the suction port to the discharge port; and guide vanes disposed between the blades to guide a flow of water.

The blades may be formed on the upper plate and coupled to first grooves formed on the lower plate.

The guide vanes may be formed on the upper plate and may be coupled to second grooves formed on the lower plate.

The guide vanes may have the same height and width as the blades and may have a shorter length than the blades.

The guide vanes may be shorter than ½ of the blade length and longer than ¼ of the blade length.

An upper casing having an inlet port and an outlet port is hermetically mounted on an upper portion of the housing, and a lower casing is sealably mounted to a lower portion of the housing, wherein at least one of the housing and the lower casing may be made of a metallic material having a thermal conductivity.

At least one of the housing and the lower casing may be manufactured by die-casting aluminum.

At least one of the housing and the lower casing may have cooling fins.

The upper casing may be formed of a resin material.

The housing may include: a first housing disposed outside; and a second housing disposed inside the first housing and partitioning the stator to prevent water from flowing into the stator, wherein the first housing may be formed of a metallic material having a thermal conductivity, and the second housing may be formed of a resin material.

Advantageous Effects

As described above, in the present disclosure, one connecting member is used to interconnect the impeller and the rotor, and the rotor is rotatably supported on the support shaft, thereby reducing the number of parts and simplifying the manufacturing process.

Also, since the inner wall portion is integrally formed in the housing and the rotor and the stator are partitioned by the inner wall portion, water can be prevented from flowing into the stator.

Also, since the center of the rotor is disposed below the center of the stator and thus a separate component for supporting the lower portion of the rotor is unnecessary due to a rising force caused when the rotor is rotated.

In addition, the housing is formed of a metal material having excellent thermal conductivity, and cooling fins are formed in at least one of the housing and the lower casing to smoothly discharge heat generated in the water pump to prevent the water pump from being damaged by heat.

BEST MODE

Figure 1:
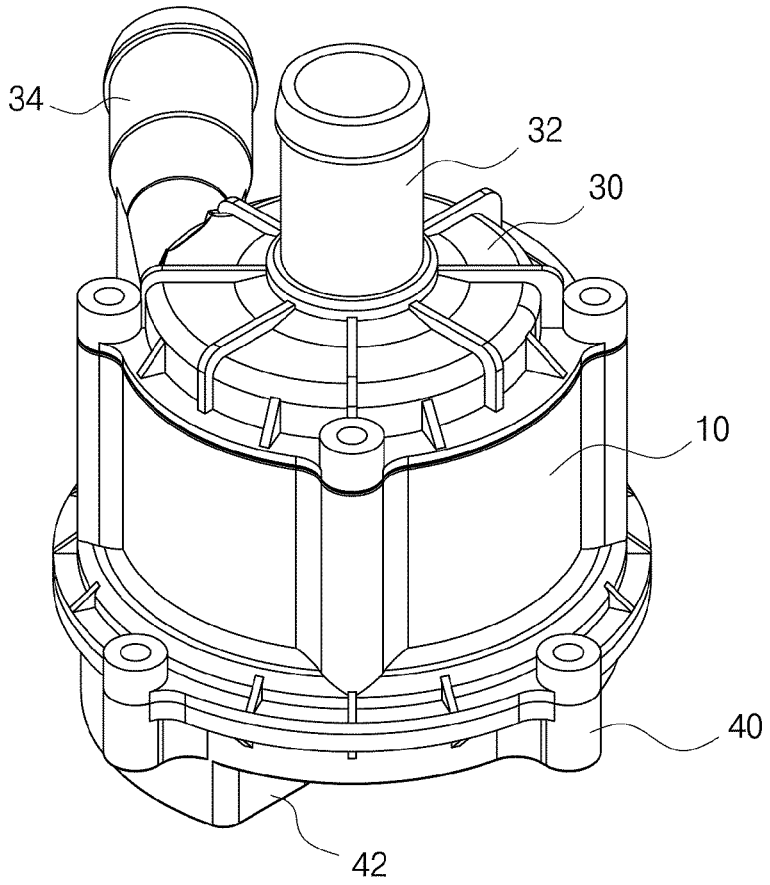
FIG. 1 is a perspective view of a water pump according to an embodiment of the present disclosure.

Hereinafter, embodiments of the present invention will be described in detail with reference to the accompanying drawings. The sizes and shapes of the components shown in the drawings may be exaggerated for clarity and convenience. In addition, terms particularly defined in consideration of the configuration and operation of the present invention may vary depending on the intention or custom of the user, the operator, and the like. Definitions of these terms should be based on the content of this specification.

Figure 2:
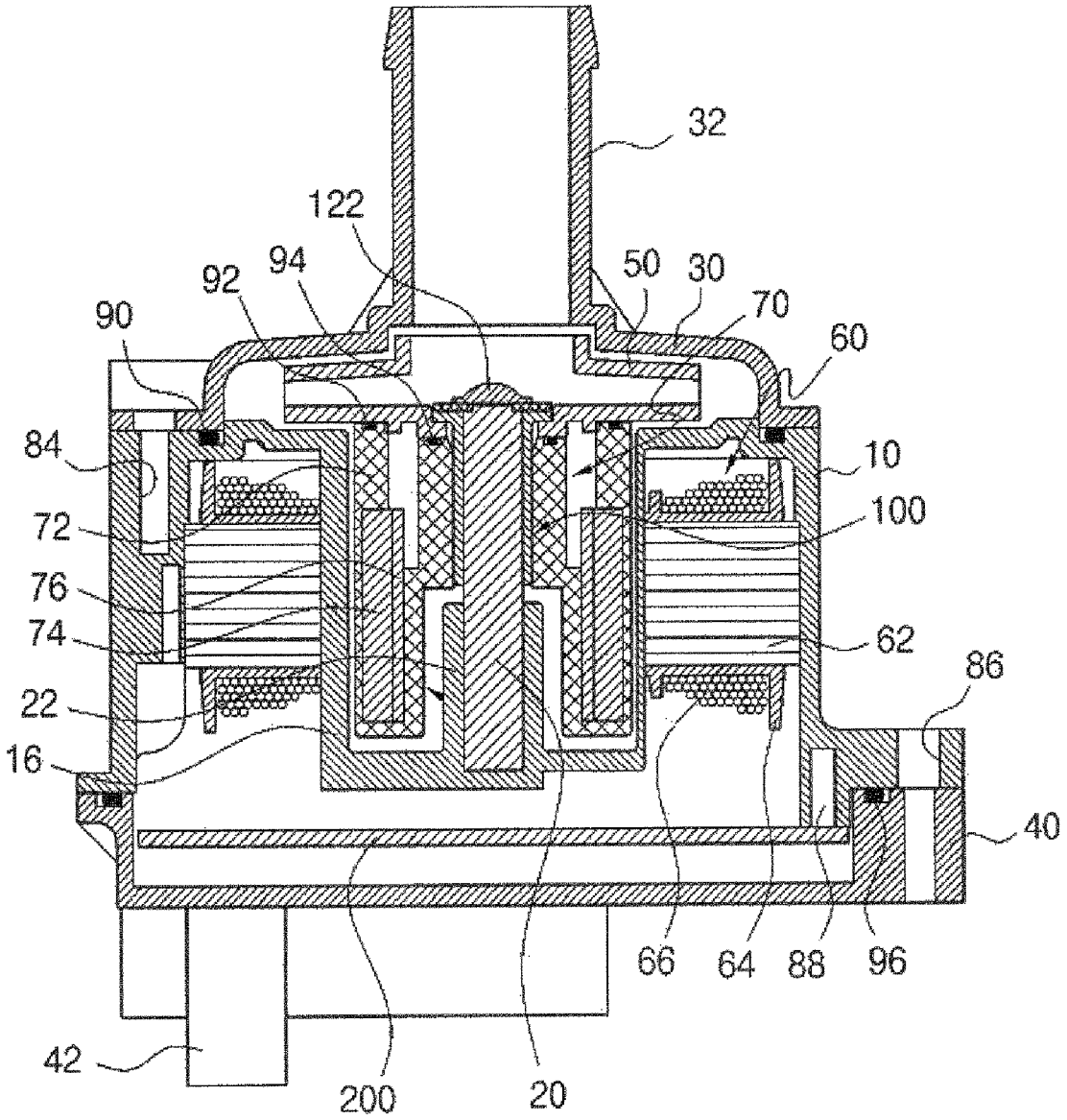
FIG. 2 is a cross-sectional view of a water pump according to an embodiment of the present disclosure.

FIG. 1 is a perspective view of a water pump according to an embodiment of the present invention, and FIG. 2 is a cross-sectional view of a water pump according to the embodiment of the present invention.

Referring to FIGS. 1 and 2, the water pump according to the embodiment of the present invention includes: a housing 10; a support shaft 20 fixed to the center of the housing 10; an upper casing 30 which is sealably mounted on an upper portion of the housing 10 and has an inlet 32 through which water is introduced and an outlet 34 through which water is discharged; a lower casing 40 in which a printed circuit board (PCB) 200 is mounted, the PCB 200 being hermetically mounted to a lower portion of the housing 10 and being electrically connected to a stator 60 so as to connect a power source and control a pump; an impeller 50 disposed inside the upper casing 30 and rotatably supported on the support shaft 20; the stator 60 disposed inside the housing 10 and to which power is applied; and a rotor 70 connected to the impeller 50 and rotatably supported to the support shaft 20.

The water pump according to an embodiment of the present invention can be used as a fluid pump for pumping fluid having viscosity in addition to water.

Figure 3:
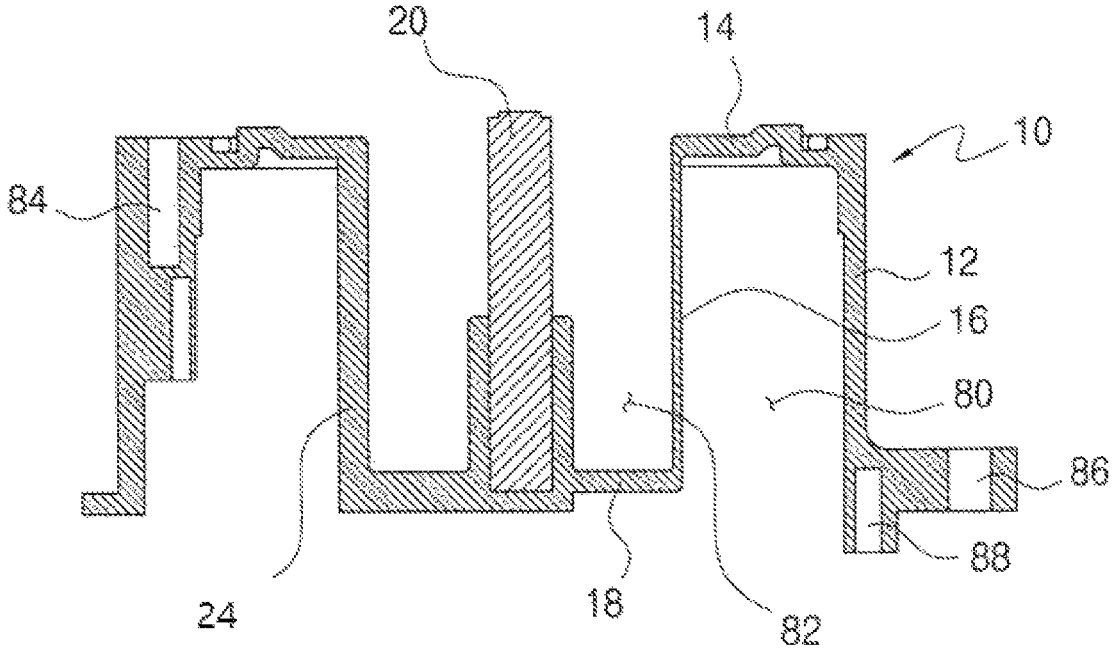
FIG. 3 is a cross-sectional view of a housing of a water pump according to an embodiment of the present disclosure.

As shown in FIG. 3, the housing 10 is provided with a rotor arrangement portion 82 in which a rotor 70 is disposed at a center thereof, and a stator arrangement portion 80 which is partitioned by the rotor arrangement portion 82 and an inner wall portion 16 in the circumferential direction of the rotor arrangement portion 82 in which the stator 60 is disposed therein.

Referring to FIGS. 2 and 3, a connector 42 for connecting the PCB 200 to an external power source is mounted on the lower casing 40.

The housing 10 includes: a cylindrical outer wall portion 12 forming an external appearance; a ring-shaped upper plate portion 14 extending inward from an upper end of the outer wall portion 12 and having a central opening; an inner wall portion 16 extending in a cylindrical shape in the downward direction from the ring-shaped upper plate portion 14; and a lower plate portion 18 covering a lower portion of the inner wall portion 16.

The stator arrangement portion 80 to which the stator 60 is fixed is formed between the outer wall portion 12 and the inner wall portion 16 and the rotor arrangement portion 82 in which the rotor 70 is disposed is formed inside the inner wall portion 16.

Accordingly, the stator 60 is hermetically sealed from the inside of the upper casing 30 (into which water is introduced) by the inner wall portion 16, the ring-shaped upper plate portion 14 and the lower plate portion 18 of the housing 10, to thereby prevent water from flowing into the stator 60.

A first bolt fastening portion 84 is formed at an upper end of the outer wall portion 12. The upper casing 30 is fixed to the first bolt fastening portion 84 by using a bolt. A second bolt fastening portion 86 and a third bolt fastening portion 88 are formed at a lower end of the outer wall portion 12. The lower casing 40 is fixed to the second bolt fastening portion 86 by using a bolt and the PCB 200 is fixed to the third bolt fastening portion 88.

A first seal ring 90 is mounted between the upper plate portion 14 and the upper casing 30 to prevent water supplied to the inside of the upper casing 30 from leaking. A second seal ring 96 is mounted between the outer wall portion 12 and the lower casings 40, thus providing sealing between the housing 10 and the lower casing 40.

A support shaft fixing portion 22 is formed at a center of the lower plate portion 18 to fix the support shaft 20 in a vertical direction. The support shaft 20 can be fitted to the support shaft fixing portion 22. The support shaft 20 and the support shaft fixing portion 22 can be integrally formed by insert molding.

The stator 60 includes a stator core 62 fixed to the stator arrangement portion 80, a bobbin 64 disposed on an outer surface of the stator core 62, and a coil 66 wound around the bobbin 64.

Figure 4:
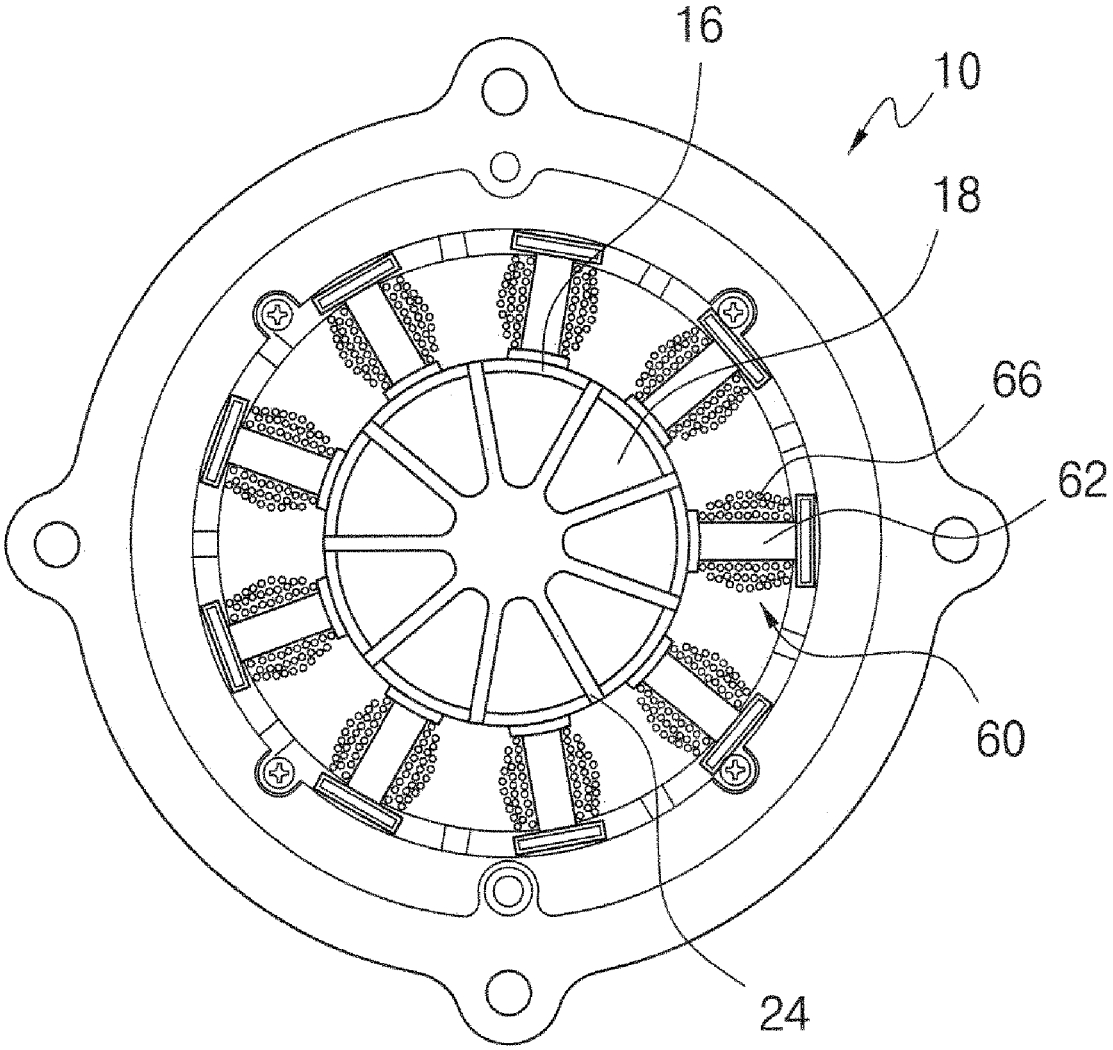
FIG. 4 is a plan view showing a structure in which a stator of a water pump according to an embodiment of the present disclosure is coupled to a housing.

As shown in FIG. 4, the housing 10 has fixed ribs 24 for aligning the position of the stator 60 and fixing the stator 60 to the housing 10.

The fixed ribs 24 are formed on an outer surface of the inner wall portion 16 and an outer surface of the lower plate portion 18 so as to protrude radially at a certain interval, in which the stator cores 62 are fitted between the fixed ribs 24.

Since the assembling is completed by fitting the stator cores 62 between the fixing ribs 24 when the stator 60 is fixed to the housing 10 as described above, a separate process for fixing the stator 60 to the housing 10 is unnecessary to thereby simplify the manufacturing process. When the stator cores 62 are fitted between the fixed ribs 24 in an annular form, the position of the stator 60 is aligned, which facilitates assembly.

Figure 5:
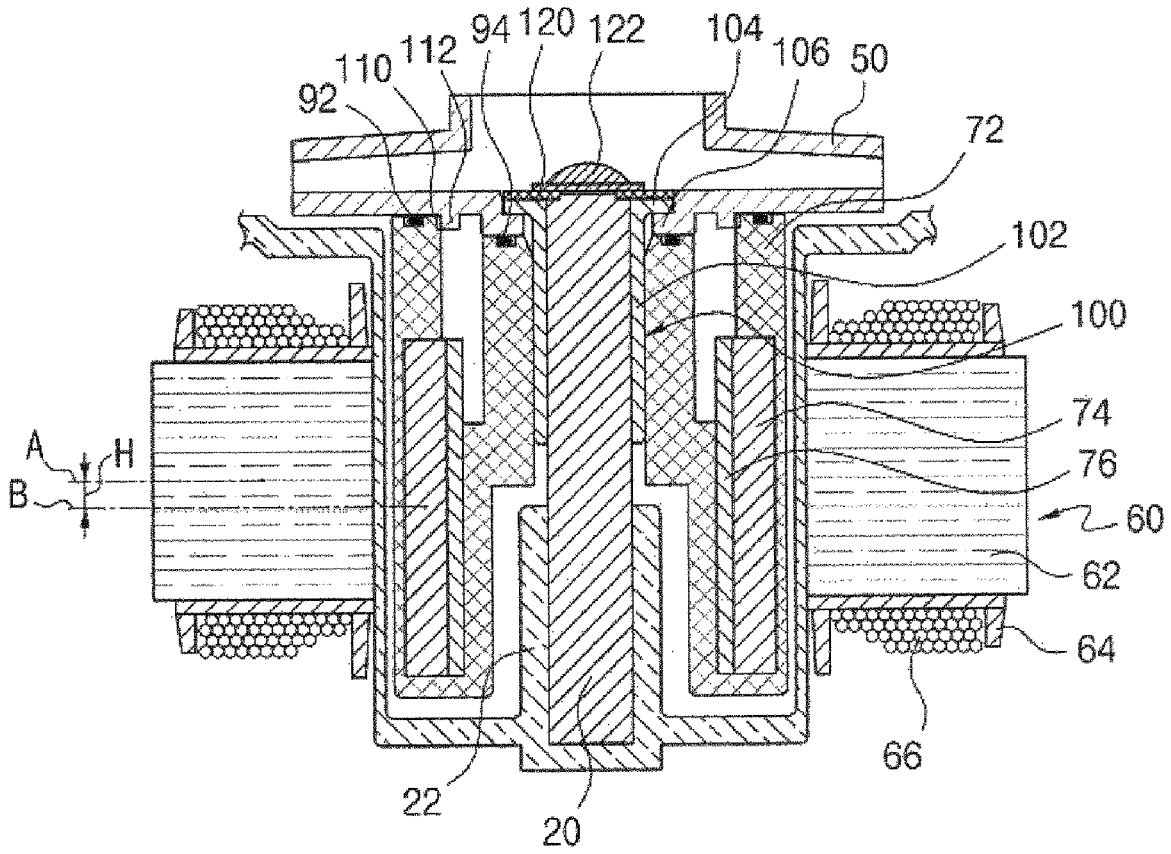
FIG. 5 is a cross-sectional view showing a structure of a rotor and a stator of a water pump according to an embodiment of the present disclosure.

Referring to FIGS. 2 and 5, the rotor 70 includes: a rotor support body 72 connected to the impeller 50 and rotatable therewith; a magnet 74 embedded in the rotor support body 72 and formed in a cylindrical shape and disposed to face the stator 60; and a back yoke 76 disposed on a rear surface of the magnet 74 and formed in a cylindrical shape.

The rotor support body 72 may be integrally formed with the magnet 74 and the back yoke 76 by an insert molding method such that the magnet 74 and the back yoke 76 are embedded in the rotor support body 72 without being exposed to the outside.

As shown in FIG. 5, the rotor support 72 and the impeller 50 are interconnected so that the rotational force of the rotor 70 can be transmitted to the impeller 50. An insertion protrusion 112 protrudes from a lower surface of the impeller 50 and an insertion groove 110 into which the insertion protrusion 112 is inserted is formed on an upper surface of the rotor support body 72.

A first straight portion is formed on an outer surface of the circular insertion protrusion 112 and a second straight portion is formed on an inner surface of the circular insertion groove 110, so that the rotational force of the rotor 70 can be transmitted to the impeller 50. Accordingly the first straight portion and the second straight portion may be in contact with each other.

In addition, in order that the rotational force of the rotor 70 may be transmitted to the impeller 50, a key protrusion may be formed on an outer surface of the insertion protrusion 112, a key groove may be formed on an inner surface of the insertion groove 110, first gear teeth may be formed on an outer surface of the insertion protrusion 112, and second gear teeth may be formed on an inner surface of the insertion groove 110.

When the rotor support body 72 is integrally formed by the insert molding with the magnet 74 and the back yoke 76, a part of the magnet 74 is exposed by a portion of fixing the magnet 74 and the back yoke 76 to an insert mold due to the characteristics of the insert mold. Therefore, a third seal ring 92 and a fourth seal ring 94 are mounted between the impeller 50 and the rotor support body 72 to prevent water from flowing into the exposed magnet 72.

When the center line A of the stator core 62 and the center line B of the magnet 74 are compared with each other, the center of the magnet 74 is lower than the center of the stator core 62 by a distance H. Therefore, due to the characteristics of the magnet 74, a force is generated so that the center of the magnet 74 is aligned with the center of the stator core 62. Accordingly, the rotor 70 is always urged upward, and thus a separate component for rotatably supporting the lower portion of the rotor 70 is unnecessary.

Also, since an upward force is generated in the rotor 70, a coupling force between the rotor 70 and the impeller 50 can be increased.

Figure 6:
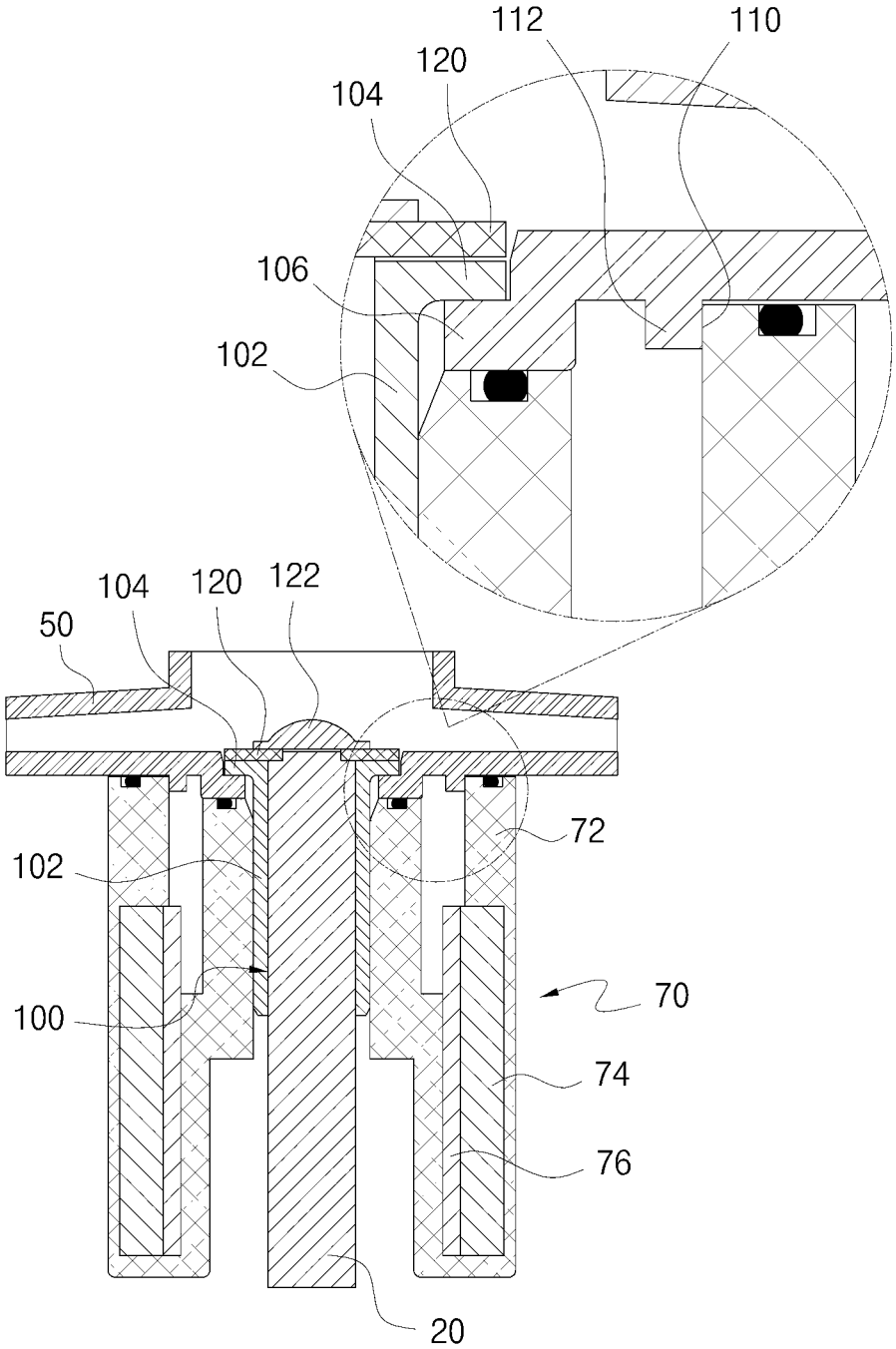
FIG. 6 is a cross-sectional view illustrating a connection structure of an impeller and a rotor of a water pump according to an embodiment of the present disclosure.

As shown in FIG. 6, the rotor 70 and the impeller 50 are coupled to each other on an outer surface of the support shaft 20, and a connecting member 100 for rotatably supporting the rotor 70 on the support shaft 20 is also mounted on the outer surface of the support shaft 20.

The process of assembling the rotor 70 and the impeller 50 is as follows. After the impeller 50 is disposed on the upper surface of the rotor support body 72, the connecting member is fitted to the inner surface of the rotor 70 and the rotor 70 and the impeller 50 are interconnected, to thus accomplish an easy and simple assembly.

Specifically, the connecting member 100 includes a cylindrical rotor fixing portion 102 rotatably inserted around the support shaft 20 and fitted to an inner surface of the rotor supporting body 72, and an impeller fixing portion 104 extending in a ring shape outward from an upper surface of the cylindrical rotor fixing portion 102 to fix the impeller 50.

The inner surface of the connecting member 100 may be rotatably supported around the support shaft 20 and the outer surface thereof may be formed as a sleeve bearing type in which the rotor 70 is fixed.

An engaging portion 106 which is engaged with the impeller fixing portion 104 is formed on a lower surface of the impeller 50.

A washer 120 is disposed on an upper surface of the connecting member 100 and a fixing bolt 122 is provided on an upper surface of the support shaft 20 to prevent the connecting member 100 from being detached from the support shaft 20.

As described above, since the rotor 70 is connected to the impeller 50 by one connecting member 100, and the rotor 70 is rotatably supported on the support shaft 20, it is unnecessary to have a component for coupling the rotor 70 and the impeller 50 and a separate bearing for rotatably supporting the rotor 70 on the support shaft 20. As a result, the number of parts can be reduced and the assembling process can be shortened.

Figure 7:
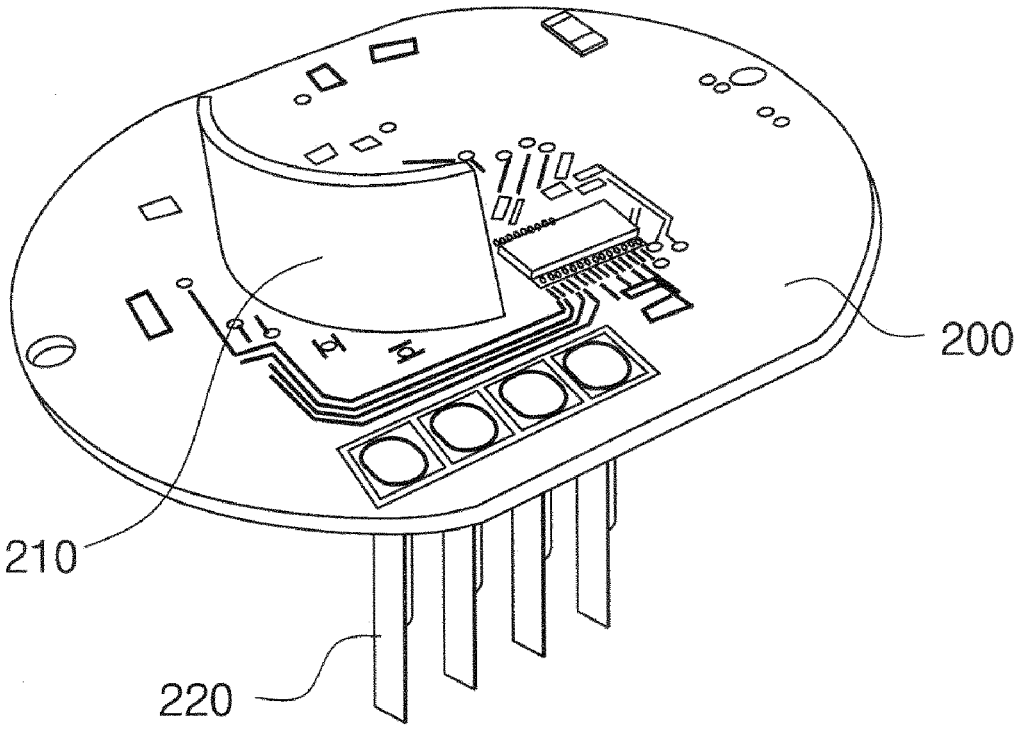
FIG. 7 is a perspective view of a PCB of a water pump according to an embodiment of the present disclosure.

As shown in FIG. 7, a Hall sensor 210 for detecting the number of rotations of the rotor 70 is integrally formed on the PCB 200, and connector pins 220 are connected on the other side of the PCB 200, to thus be protruded to the outside of the lower casing 40.

Since the Hall sensor 210 and the connector pins 220 are integrally formed on the PCB 200, as described above, a separate component for connecting the Hall sensor to the PCB 200 is unnecessary.

Figure 8:
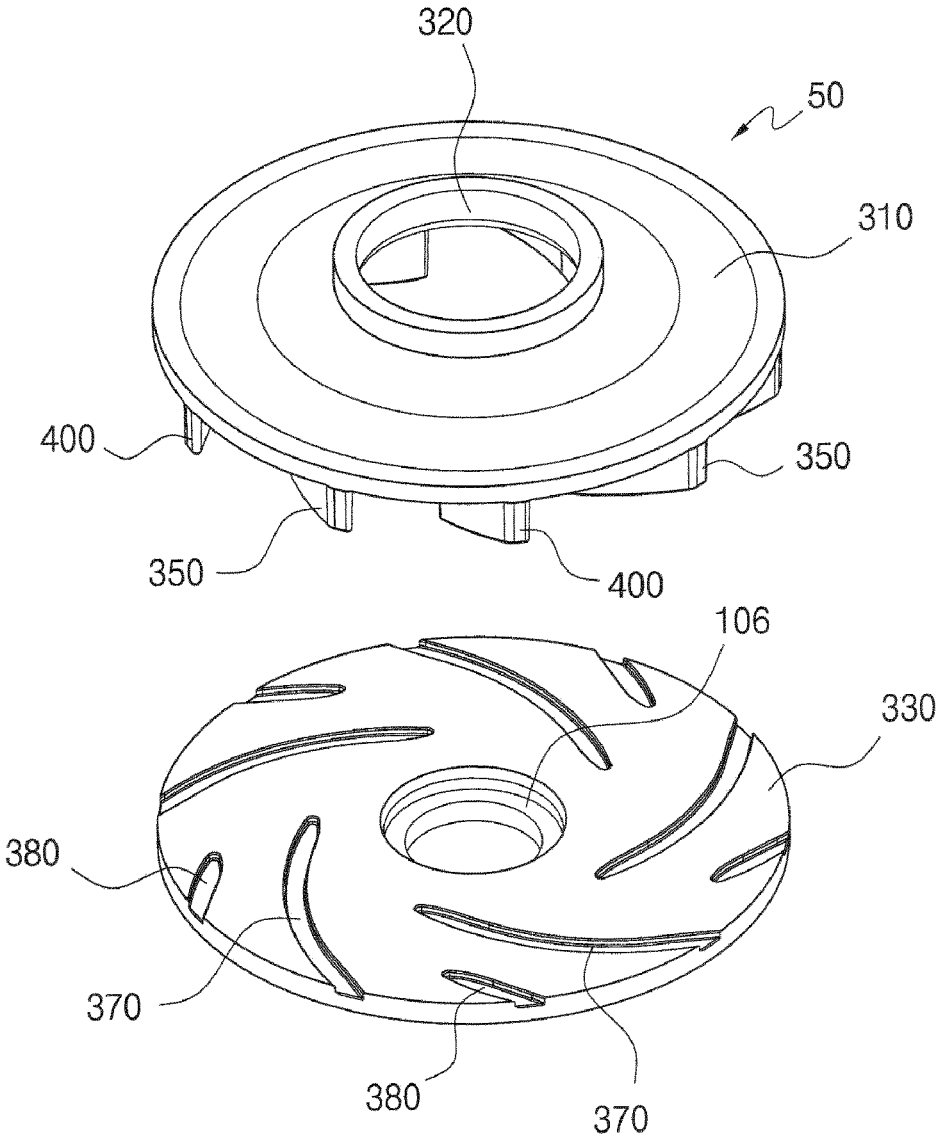
FIG. 8 is an exploded perspective view of an impeller of a water pump according to an embodiment of the present disclosure.
Figure 9:
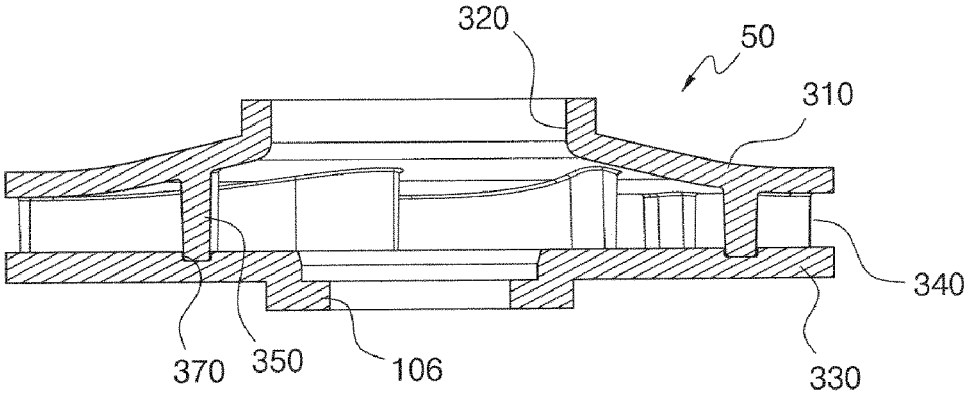
FIG. 9 is a cross-sectional view of an impeller of a water pump according to an embodiment of the present disclosure.
Figure 10:
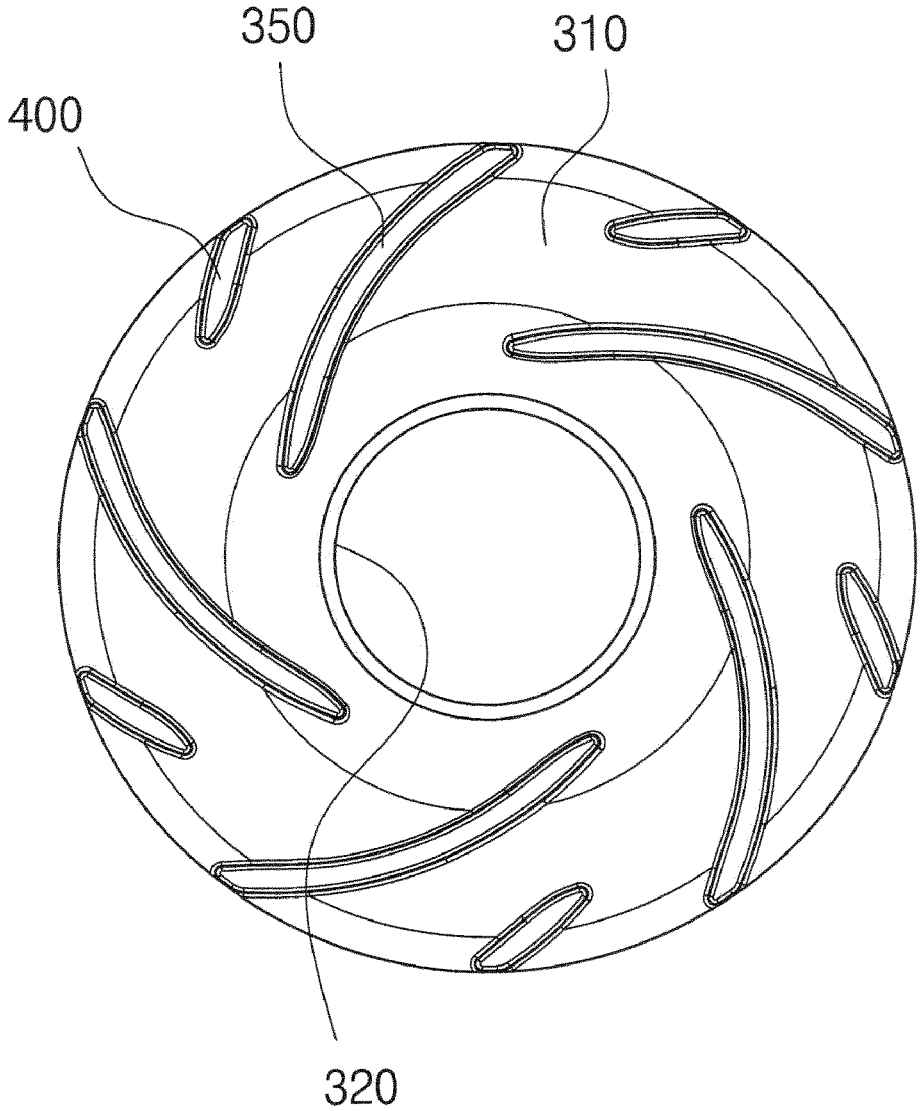
FIG. 10 is a top plan view of an impeller according to an embodiment of the present disclosure.

As shown in FIGS. 8 to 10, the impeller 50 includes: an upper plate 310 having a disk shape and having a suction port 320 through which water is sucked in a center thereof; a lower plate 330 disposed facing the upper plate 310 at a distance spaced apart from the upper plate 310 and forming a discharge port 340 between the upper plate 310 and the lower plate 330; and blades 350 disposed between the upper plate 310 and the lower plate 330, for generating a pumping force for discharging water sucked through the suction port 320 to the discharge port 340.

The blades 350 are formed integrally with the upper plate 310 by a mold and are protruded at a certain interval in a circumferential direction at a lower surface of the upper plate 310, and are inclined in a curved form outwardly from the inside of the upper plate 310, to thereby generate a pumping force for discharging the water sucked into the suction port 320 to the discharge port 340.

The shape, the length, and the width of each blade 350 can be formed so as to satisfy the condition that the pumping force can be maximized when the water sucked in the vertical direction of the impeller 50 is discharged in the lateral direction of the impeller 50.

The impeller 50 applied to the water pump according to an embodiment of the present invention has a problem that the flow resistance of water increases because the flow of water is converted at a right angle when water flows in a vertical direction and is discharged in a horizontal direction. That is, when the water sucked into the suction port 320 is discharged in the horizontal direction by the blades 350, the load of the impeller 50 is increased by the flow resistance of the water, and thus there are problems that performance of the impeller 50 is declined and noise and vibration are generated.

In this embodiment, guide vanes 400 for guiding the flow of water between the blades 350 are provided so that the flow of water can be smoothly performed, to thereby improve performance of the impeller 50, and minimize noise and vibration.

The guide vanes 400 are disposed between the blades 350 and are formed to have the same height and width as the blades 350 and to be shorter than the blades 350.

The guide vanes 400 are disposed at an inclined angle from an edge of the upper plate 310 to an inner side of the upper plate 310 and each guide vane is shorter than ½ of the length of each blade 350 and longer than ¼ thereof.

That is, when each guide vane 400 is longer than ½ of the length of each blade 350, the guide vanes 400 serve as blades for pumping water, to thus cause the number of the blades 350 to increase. As a result, the flow resistance of the water can be made larger.

In addition, when each guide vane 400 is shorter than ¼ of the length of each blade 350, the guide vanes 400 cannot guide water flow.

The lower plate 330 is provided with first groove portions 370 having the same shapes as the blades 350 and second groove portions 380 having the same shapes as the guide vanes 400, so that one side of each blade 350 and one side of each guide vane 400 are inserted into each of the first groove portions 370 and each of the second groove portions 380.

Between the upper plate 310 and the lower plate 330, the blades 350 can be tightly fitted with the first groove portions 370 and the guide vanes 400 can be tightly fitted with the second groove portions 380.

In addition, the upper plate 310 and the lower plate 330 can be joined by bonding the blades 350 to the first groove portions 370 and bonding the guide vanes 400 to the second groove portions 380.

In addition, the upper plate 310 and the lower plate 330 can be joined by thermally fusing the blades 350 to the first groove portions 370 and thermally fusing the guide vanes 400 to the second groove portions 380.

Besides, any fixing method capable of mutually fixing the resinous upper and lower plates can be applied.

As described above, in some embodiments, the impeller 50 is provided with the guide vanes 400 between the blades 350 to guide the flow of water smoothly, thereby improving the performance of the impeller 50, and minimizing noise and vibration.

As shown in FIGS. 8 to 10, the impeller 50 includes: an upper plate 310 having a disk shape and having a suction port 320 through which water is sucked in a center thereof; a lower plate 330 disposed facing the upper plate 310 at a distance spaced apart from the upper plate 310 and forming a discharge port 340 between the upper plate 310 and the lower plate 330; and blades 350 disposed between the upper plate 310 and the lower plate 330, for generating a pumping force for discharging water sucked through the suction port 320 to the discharge port 340.

The blades 350 are formed integrally with the upper plate 310 by a mold and are protruded at a certain interval in a circumferential direction at a lower surface of the upper plate 310, and are inclined in a curved form outwardly from the inside of the upper plate 310, to thereby generate a pumping force for discharging the water sucked into the suction port 320 to the discharge port 340.

The shape, the length, and the width of each blade 350 can be formed so as to satisfy the condition that the pumping force can be maximized when the water sucked in the vertical direction of the impeller 50 is discharged in the lateral direction of the impeller 50.

The impeller 50 applied to the water pump according to an embodiment of the present invention has a problem that the flow resistance of water increases because the flow of water is converted at a right angle when water flows in a vertical direction and is discharged in a horizontal direction. That is, when the water sucked into the suction port 320 is discharged in the horizontal direction by the blades 350, the load of the impeller 50 is increased by the flow resistance of the water, and thus there are problems that performance of the impeller 50 is declined and noise and vibration are generated.

In this embodiment, guide vanes 400 for guiding the flow of water between the blades 350 are provided so that the flow of water can be smoothly performed, to thereby improve performance of the impeller 50, and minimize noise and vibration.

The guide vanes 400 are disposed between the blades 350 and are formed to have the same height and width as the blades 350 and to be shorter than the blades 350.

The guide vanes 400 are disposed at an inclined angle from an edge of the upper plate 310 to an inner side of the upper plate 310 and each guide vane is shorter than ½ of the length of each blade 350 and longer than ¼ thereof.

That is, when each guide vane 400 is longer than ½ of the length of each blade 350, the guide vanes 400 serve as blades for pumping water, to thus cause the number of the blades 350 to increase. As a result, the flow resistance of the water can be made larger.

In addition, when each guide vane 400 is shorter than ¼ of the length of each blade 350, the guide vanes 400 cannot guide water flow.

The lower plate 330 is provided with first groove portions 370 having the same shapes as the blades 350 and second groove portions 380 having the same shapes as the guide vanes 400, so that one side of each blade 350 and one side of each guide vane 400 are inserted into each of the first groove portions 370 and each of the second groove portions 380.

Between the upper plate 310 and the lower plate 330, the blades 350 can be tightly fitted with the first groove portions 370 and the guide vanes 400 can be tightly fitted with the second groove portions 380.

In addition, the upper plate 310 and the lower plate 330 can be joined by bonding the blades 350 to the first groove portions 370 and bonding the guide vanes 400 to the second groove portions 380.

In addition, the upper plate 310 and the lower plate 330 can be joined by thermally fusing the blades 350 to the first groove portions 370 and thermally fusing the guide vanes 400 to the second groove portions 380.

Besides, any fixing method capable of mutually fixing the resinous upper and lower plates can be applied.

As described above, in some embodiments, the impeller 50 is provided with the guide vanes 400 between the blades 350 to guide the flow of water smoothly, thereby improving the performance of the impeller 50, and minimizing noise and vibration.

Figure 11:
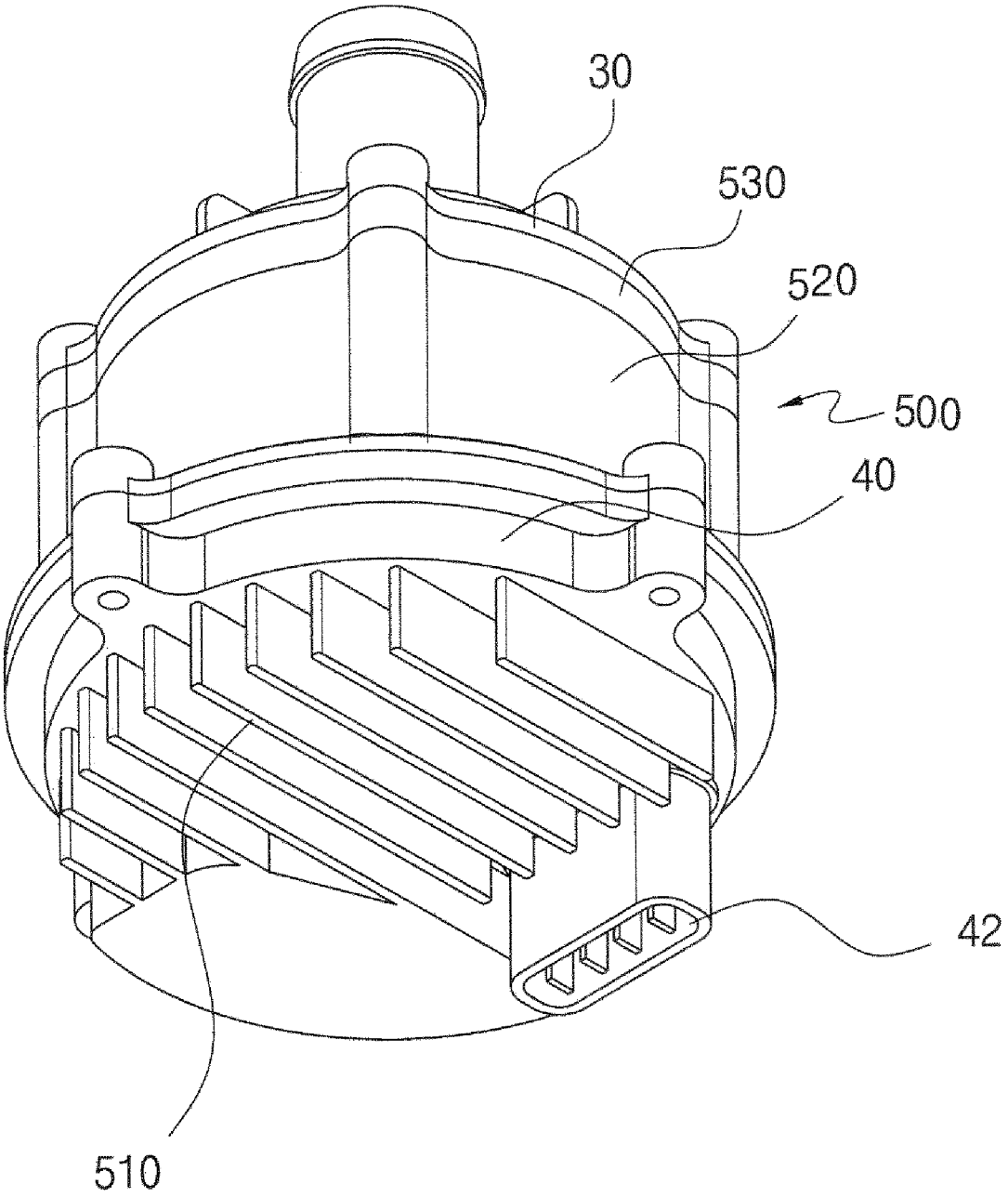
FIG. 11 is a perspective view of a water pump according to another embodiment of the present disclosure.
Figure 12:
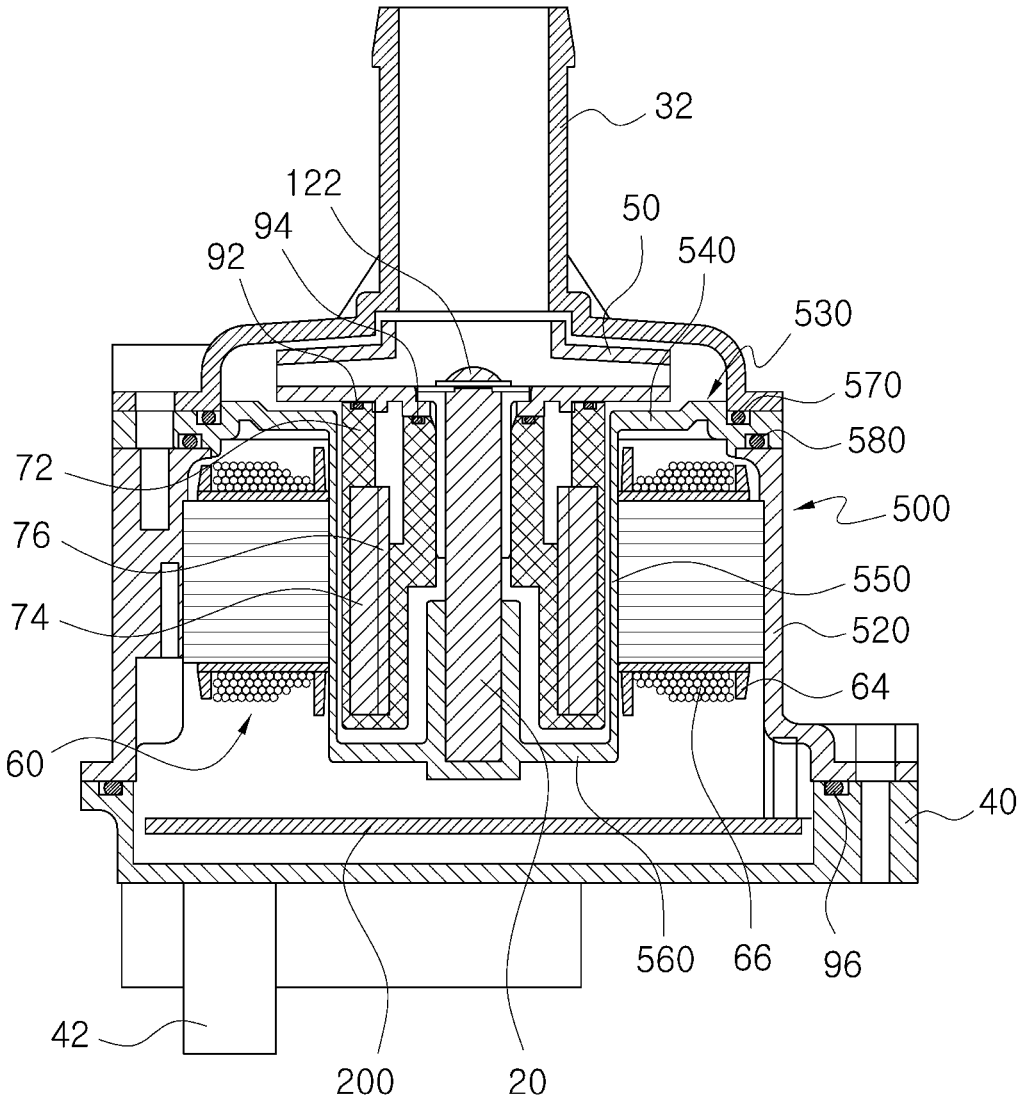
FIG. 12 is a cross-sectional view of a water pump according to another embodiment of the present disclosure.

FIG. 11 is a perspective view of a water pump according to another embodiment of the present invention. FIG. 12 is a cross-sectional view of a connector according to another embodiment of the present invention.

The water pump according to another embodiment includes: a housing 500; an upper casing 30 which is sealably mounted on an upper portion of the housing 500 and has an inlet 32 through which water is introduced and an outlet 34 through which water is discharged; and a lower casing 40 in which a printed circuit board (PCB) 200 is mounted, the PCB 200 being hermetically mounted to a lower portion of the housing 10 and being electrically connected to a stator 60 so as to connect a power source and control a pump.

To this end, the housing 500 is formed of a metal material having an excellent thermal conductivity, the upper casing 30 is formed of a resin material, and the lower casing 40 is formed of a metal material having an excellent thermal conductivity.

In the case of the upper casing 30, the inlet 32 and the outlet 34 are formed. Therefore, the upper casing 30 is formed of a resin material having excellent moldability because of its complicated structure. In addition, water flows into the upper casing 30. Therefore, it is not necessary to have a separate cooling structure, in the upper casing 30.

The rotor 70 and the stator 60 which directly generate heat are disposed inside the housing 500 and the lower casing 40. Therefore, the rotor 70 and the stator 60 are formed of a metal material having an excellent thermal conductivity. As a result, heat generated from the rotor 70 and the stator 60 can be quickly discharged to the outside.

The housing 500 and the lower casing 40 may be manufactured by die-casting an aluminum material having an excellent thermal conductivity, or may use any metal having an excellent thermal conductivity other than aluminum.

Here, cooling fins 510 are formed on at least one of the housing 500 and the lower casing 40 to improve heat discharge performance.

In this embodiment, the cooling fins 510 are formed on the lower surface of the lower casing 40 so as to protrude at regular intervals in the form of a flat plate. The cooling fins 510 may be formed radially in the circumferential direction on the outer surface of the housing, but not shown in the drawing.

As described above, in the water pump according to the embodiment of the present invention, the housing 500 and the lower casing 40 are formed of a metal material having an excellent thermal conductivity, and the upper casing 30 is formed of a resin material having good moldability. Therefore, heat generated inside the water pump can be quickly discharged to the outside, while reducing manufacturing costs.

The housing 500 includes a first housing 520 which is formed in a cylindrical shape and which is disposed on the outside and a second housing 530 which is hermetically connected to the first housing 520 and which partitions the stator 60 to prevent the infiltration of water to the stator 60.

The first housing 520 is formed in a cylindrical shape, the lower end thereof is sealably fixed to the lower casing 40, and the upper end thereof is sealably fixed to the second housing 5300.

The second housing 530 includes: an upper plate portion 540 which has a disk shape and is fixed between the upper casing 30 and the second housing 530; an inner wall portion 550 which has a cylindrical shape in the downward direction at an end portion of the upper plate 540; and a lower plate portion 560 covering a lower portion of the inner wall portion 550.

An upper seal ring 570 is mounted between the second housing 530 and the upper casing 30 and a lower seal ring 580 is mounted between the second housing 530 and the first housing 520, thereby sealing between the upper casing 30 and the second housing 530, and between the second housing 530 and the first housing 520, respectively.

The first housing 520 is formed of a metal material having an excellent thermal conductivity, and the second housing 530 is formed of a resin material. That is, when the whole of the housing 500 is made of metal, the manufacturing cost increases. Therefore, the second housing 530 surrounding the rotor 70 is made of a resin material, and the first housing 520 surrounding the stator 60 is formed of a metal material having an excellent thermal conductivity, to thus rapidly discharge heat generated in the stator 60 to the outside.

While the present invention has been particularly shown and described with reference to exemplary embodiments thereof, by way of illustration and example only, it is clearly understood that the present invention is not to be construed as limiting the present invention, and various changes and modifications may be made by those skilled in the art within the protective scope of the invention without departing off the spirit of the present invention.

INDUSTRIAL APPLICABILITY

The water pump according to the embodiments of the present invention is used in a drainage tank of a washing machine or used for circulating cooling water of an automobile engine, which can reduce the number of parts and simplify the manufacturing process. In addition, the water pump is configured so that the inner wall portion is integrally formed in the housing, and the rotor and the stator are partitioned by the inner wall portion, to thus prevent water from being introduced into the stator, thereby improving performance.

What is claimed is:

1. A water pump comprising:

a housing;

a support shaft fixed to the housing;

an impeller disposed on an upper portion of the housing, the impeller including an insertion protrusion protruding from a lower surface thereof;

a stator disposed inside the housing;

a rotor disposed inside the housing and fixed to a rotor support, the rotor support including an insertion groove formed on an upper surface thereof, and the insertion protrusion being inserted into the insertion groove so that a rotational force of the rotor is transmitted to the impeller; and a connecting member rotatably connecting the impeller to the rotor support, wherein the connecting member comprises:

a cylindrical rotor fixing portion inserted between the rotor support and the support shaft, and having an inner circumferential surface rotatably engaged with an outer circumferential surface of the support shaft, and an outer circumferential surface fixedly engaged with an inner circumferential surface of the rotor support; and an impeller fixing portion integrally extending outwardly from an upper end portion of the cylindrical rotor fixing portion to form a T-shaped cross section and engaging with an engaging portion formed in a lower portion of the impeller.

2. The water pump according to claim 1, wherein the housing comprises: an outer wall portion; a ring-shaped upper plate portion extending inward from an upper end of the outer wall portion; an inner wall portion extending downward from an inner end portion of the ring-shaped upper plate portion; and a lower plate portion covering an area formed between a lower portion of the inner wall portion, and wherein the stator is disposed between the outer wall portion and the inner wall portion, the rotor support and the rotor are disposed inside the inner wall portion, and the support shaft is fixed on the lower plate portion.

3. The water pump according to claim 1, wherein the rotor comprises: a magnet; and a cylindrical back yoke embedded in the rotor support.

4. The water pump according to claim 3, wherein a center of the magnet is positioned lower than a center of the stator by an interval (H) so that an upward force can be applied to the magnet.

5. The water pump according to claim 2, wherein a printed circuit board (PCB) for controlling the stator is mounted on a lower side of the housing, a Hall sensor for detecting rotations of the rotor is mounted on one side of the PCB, and connector pins are connected to another side of the PCB.

6. The water pump according to claim 1, wherein the impeller comprises: an upper plate having a suction port for sucking water in a center thereof; a lower plate coupled to the upper plate to form a discharge port between the upper plate and the lower plate; and a plurality of blades disposed between the upper plate and the lower plate and generating a pumping force for discharging water sucked through the suction port to the discharge port; and guide vanes disposed between the blades to guide a flow of water.

7. The water pump according to claim 6, wherein the blades are formed on the upper plate and coupled to grooves formed on the lower plate.

8. The water pump according to claim 6, wherein the guide vanes are formed on the upper plate and coupled to grooves formed on the lower plate.

9. The water pump according to claim 6, wherein the guide vanes have the same height and width as the blades and have a shorter length than the blades.

10. The water pump according to claim 6, wherein the guide vanes have a length shorter than ½ of a blade length and longer than ¼ of the blade length.

11. The water pump according to claim 1, wherein an upper casing having an inlet port and an outlet port is hermetically mounted on the upper portion of the housing, and a lower casing is sealably mounted to a lower portion of the housing, wherein at least one of the housing and the lower casing is made of a metallic material.

12. The water pump according to claim 11, wherein the metallic material includes an aluminum.

13. The water pump according to claim 11, wherein the lower casing has cooling fins.

14. The water pump according to claim 11, wherein the upper casing is formed of a resin material.

15. The water pump according to claim 11, wherein the housing comprises: a first housing; and a second housing disposed inside the first housing, wherein the first housing is formed of a metallic material, and the second housing is formed of a resin material.

* * * * *